US008696533B2

(12) United States Patent
Wang

(10) Patent No.: US 8,696,533 B2
(45) Date of Patent: Apr. 15, 2014

(54) REHABILITATION EXERCISING EQUIPMENT THAT CAN EXTEND A USER'S WAIST, ARMS AND LEGS

(75) Inventor: Shih-Jung Wang, Taiping (TW)

(73) Assignee: Preventative Medical Health Care Co., Ltd, Guishan Township (TW)

( * ) Notice: Subject to any disclaimer, the term of this patent is extended or adjusted under 35 U.S.C. 154(b) by 302 days.

(21) Appl. No.: 13/170,249

(22) Filed: Jun. 28, 2011

(65) Prior Publication Data

US 2013/0005546 A1 Jan. 3, 2013

(51) Int. Cl.
*A63B 22/00* (2006.01)
*A63B 26/00* (2006.01)
*A63B 69/06* (2006.01)

(52) U.S. Cl.
USPC ..... 482/142; 482/51; 482/72

(58) Field of Classification Search
USPC ..... 482/51–52, 57, 62–63, 72–73, 92, 115, 482/121–123, 133–138, 140, 142, 148; 601/5, 23, 33–36
See application file for complete search history.

(56) References Cited

U.S. PATENT DOCUMENTS 3,213,852 A * 10/1965 Zent ..... 601/36
3,216,722 A * 11/1965 Odom ..... 482/62
4,436,097 A * 3/1984 Cunningham ..... 600/520
4,570,927 A * 2/1986 Petrofsky et al. ..... 482/60
4,627,619 A * 12/1986 Rockwell et al. ..... 482/137
5,356,356 A * 10/1994 Hildebrandt et al. ..... 482/62
5,702,332 A * 12/1997 Hsieh ..... 482/130
5,709,633 A * 1/1998 Sokol ..... 482/62
5,779,600 A * 7/1998 Pape ..... 482/72
5,836,856 A * 11/1998 Mattoo et al. ..... 482/62
6,004,244 A * 12/1999 Simonson ..... 482/52
6,220,991 B1 * 4/2001 Sellers ..... 482/62
6,852,070 B1 * 2/2005 Herbert ..... 482/57
7,066,868 B2 * 6/2006 Van Den Heever ..... 482/142
7,267,639 B2 * 9/2007 Kuo ..... 482/62
7,530,932 B2 * 5/2009 Lofgren et al. ..... 482/62
2003/0060337 A1 * 3/2003 Yu ..... 482/57
2007/0298937 A1 * 12/2007 Shah et al. ..... 482/54
2012/0231929 A1 * 9/2012 Hsieh ..... 482/5

* cited by examiner

*Primary Examiner* — Oren Ginsberg
*Assistant Examiner* — Gregory Winter
(74) *Attorney, Agent, or Firm* — Alan Kamrath; Kamrath IP Lawfirm, P.A.

(57) ABSTRACT

Rehabilitation exercising equipment includes a frame unit, a seat unit mounted on the frame unit, a first geared member rotatably mounted on the frame unit, a second geared member rotatably mounted on the frame unit, a connecting member mounted between the first geared member and the second geared member to connect the first geared member and the second geared member, and a control handle connected with the first geared member. Thus, a user's hands can hold the control handle to move the control handle forward and backward so as to exercise or rehabilitate the user's waist, arms and legs.

16 Claims, 11 Drawing Sheets

REHABILITATION EXERCISING EQUIPMENT THAT CAN EXTEND A USER'S WAIST, ARMS AND LEGS

BACKGROUND OF THE INVENTION

1. Field of the Invention

The present invention relates to rehabilitation equipment and, more particularly, to rehabilitation exercising equipment.

2. Description of the Related Art

A Conventional rehabilitation equipment comprises a support frame, a pedal portion mounted on the support frame, and a handle portion mounted on the support frame and connected with the pedal portion to move in concert with the pedal portion. Thus, when a user holds the handle portion and treads the pedal portion, the handle portion is driven by the pedal portion to move upward and downward so as to provide a rehabilitating function to the user's two hands. However, when the user's legs are injured, he/she cannot tread the pedal portion to drive the handle portion easily, thereby causing inconvenience to the user, and thereby decreasing the rehabilitating effect of the rehabilitation equipment.

BRIEF SUMMARY OF THE INVENTION

In accordance with the present invention, there is provided rehabilitation exercising equipment, comprising a frame unit, a seat unit mounted on the frame unit, a first geared member rotatably mounted on the frame unit, a second geared member rotatably mounted on the frame unit, a connecting member mounted between the first geared member and the second geared member to connect the first geared member and the second geared member so that the first geared member and the second geared member are movable in concert with each other, and a control handle connected with the first geared member.

The primary objective of the present invention is to provide rehabilitation exercising equipment that can extend a user's waist, arms and legs.

According to the primary advantage of the present invention, a user's hands can hold the control handle to move the control handle forward and backward so as to exercise or rehabilitate the user's waist, arms and legs, thereby achieving an exercising or rehabilitating function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
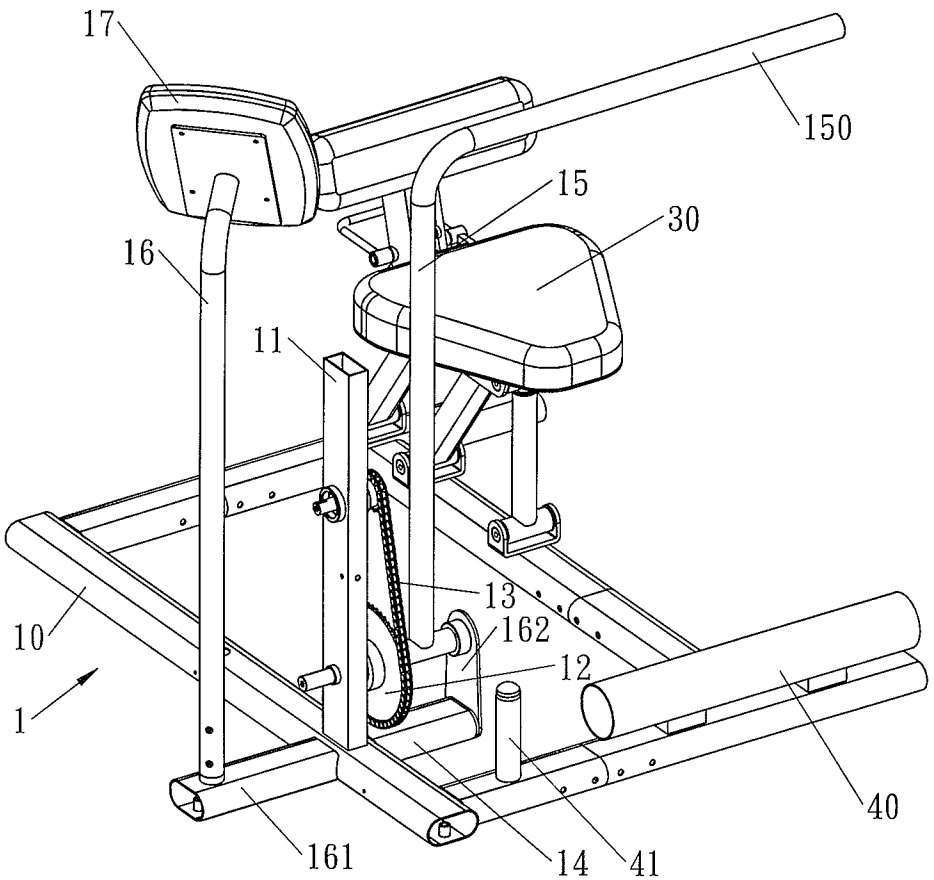
FIG. 1 is a perspective view of rehabilitation exercising equipment in accordance with the preferred embodiment of the present invention.

Referring to the drawings and initially to FIGS. 1-5, rehabilitation exercising equipment in accordance with the preferred embodiment of the present invention comprises a frame unit 1, a seat unit 30 mounted on the frame unit 1, a bearing 31 (FIG. 4) mounted between the seat unit 30 and the frame unit 1, a first geared member 12 rotatably mounted on the frame unit 1, a second geared member 19 rotatably mounted on the frame unit 1, a connecting member 13 mounted between the first geared member 12 and the second geared member 19 to connect the first geared member 12 and the second geared member 19 so that the first geared member 12 and the second geared member 19 are movable in concert with each other, a control handle 5 connected with the first geared member 12, a foot support 40 mounted on the frame unit 1, and an upright limit rod 41 mounted on the frame unit 1 to limit a further movement of the control handle 5.

The frame unit 1 includes a main frame 10, an upright support post 11 mounted on the main frame 10 to support the first geared member 12 and the second geared member 19, a transverse extension 161 mounted on the main frame 10, an upright support bar 16 mounted on the extension 161, a control panel 17 mounted on the support bar 16, a support beam 14 mounted on the main frame 10, a mounting bracket 162 connected with the support beam 14 and abutting the control handle 5 to support the control handle 5, a rotation shaft 18 rotatably mounted on the support post 11 and connected with the second geared member 19, and a support shaft 111 mounted on the support post 11 to support the first geared member 12. The control panel 17 of the frame unit 1 is preferably an electronic instrument panel. The support post 11 of the frame unit 1 is provided with a shaft hole 112 to support the rotation shaft 18. The rotation shaft 18 of the frame unit 1 is rotatably mounted in the shaft hole 112 of the support post 11.

The control handle 5 has a substantially inverted L-shaped profile and has a first end connected with the first geared member 12 to move in concert with the first geared member 12 and a second end provided with a grip portion 150. The first end of the control handle 5 is provided with a first connector 152 connected with the first geared member 12. The first connector 152 of the control handle 5 is disposed between the first geared member 12 and the mounting bracket 162 of the frame unit 1. The first connector 152 of the control handle 5 is rotatably mounted on the mounting bracket 162 of the frame unit 1. The control handle 5 is movable relative to the frame unit 1 to abut the limit rod 41.

The seat unit 30, the foot support 40 and the limit rod 41 are mounted on the main frame 10 of the frame unit 1.

The first geared member 12 is rotatably mounted on the support shaft 111 of the frame unit 1. The first geared member 12 has a side provided with a second connector 121 connected with the first connector 152 of the control handle 5. The second geared member 19 is secured on the rotation shaft 18 of the frame unit 1 to rotate in concert with the rotation shaft 18 of the frame unit 1. The second geared member 19 is located above the first geared member 12.

In the preferred embodiment of the present invention, the connecting member 13 is a toothed belt. Alternatively, each of the first geared member 12 and the second geared member 19 is a sprocket, and the connecting member 13 is a chain meshing with the sprocket.

Figure 2:
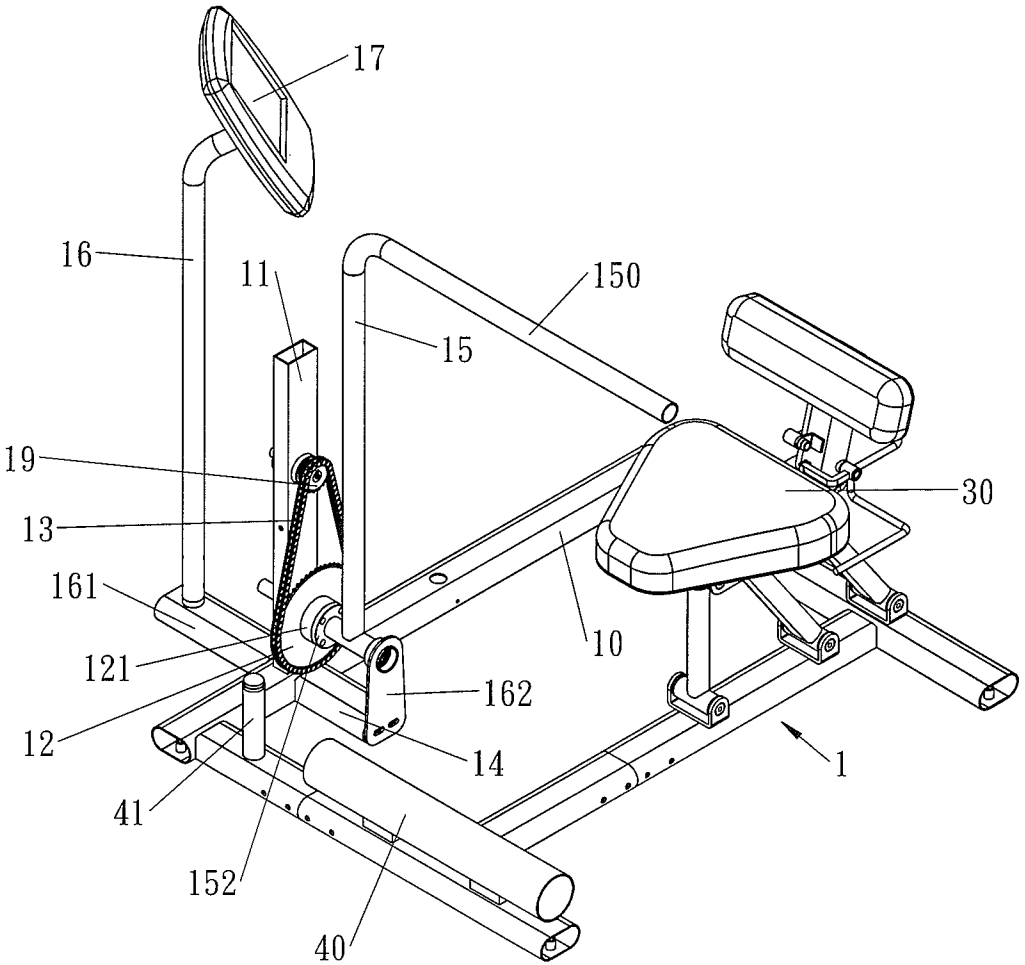
FIG. 2 is another perspective view of the rehabilitation exercising equipment as shown in FIG. 1.
Figure 3:
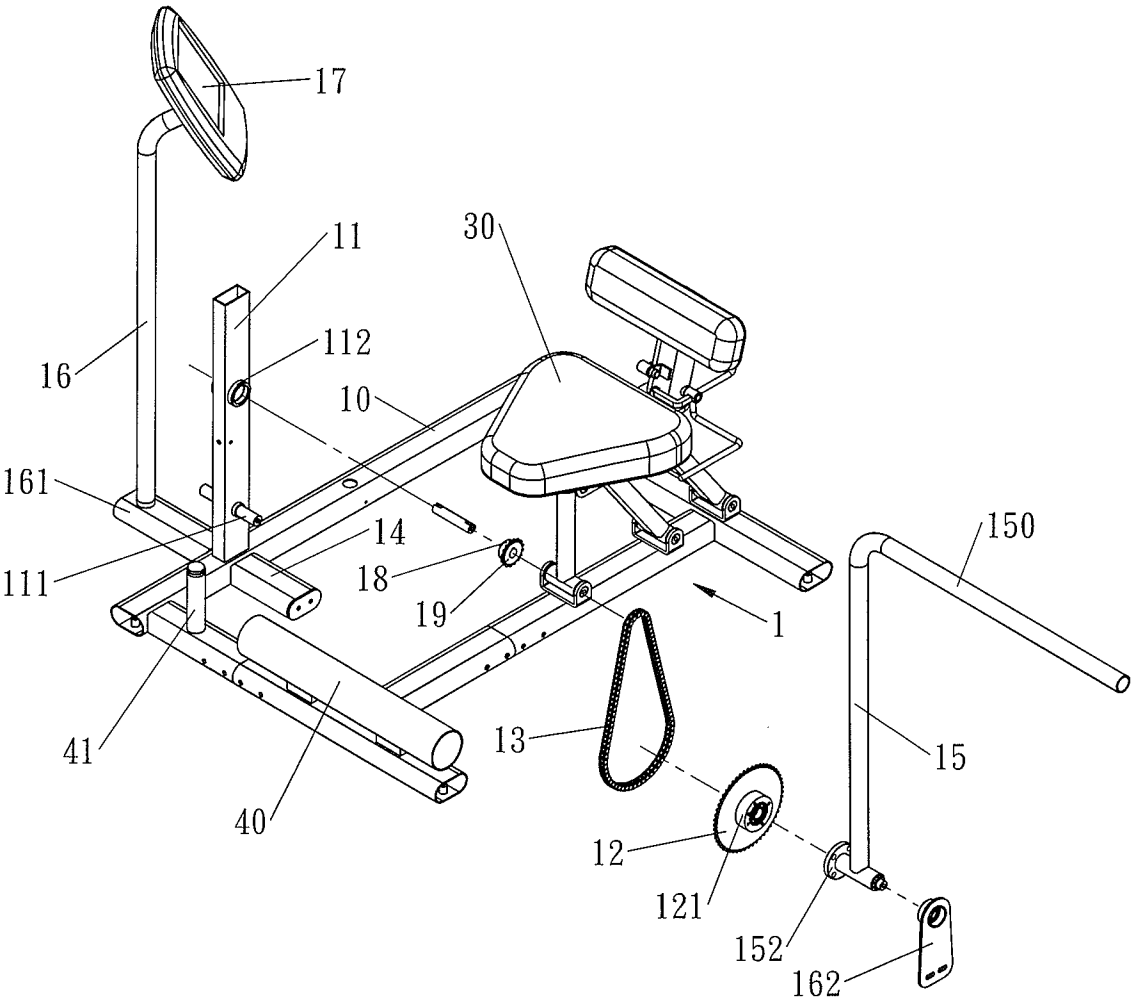
FIG. 3 is an exploded perspective view of the rehabilitation exercising equipment as shown in FIG. 1.
Figure 4:
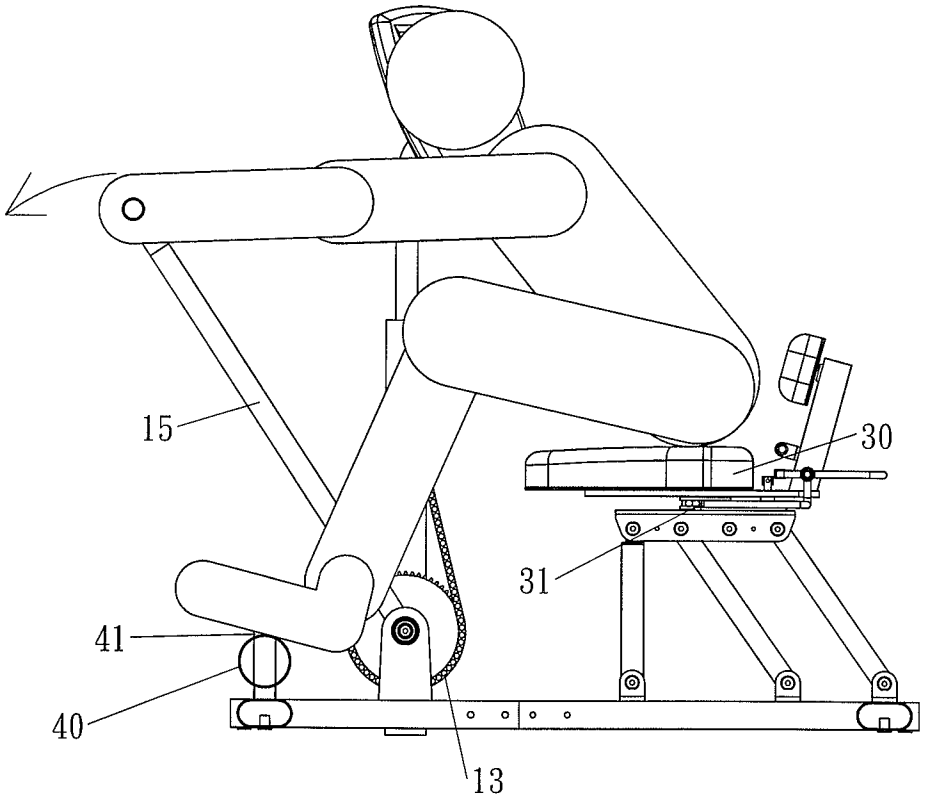
FIG. 4 is a side operational view of the rehabilitation exercising equipment as shown in FIG. 2.
Figure 5:
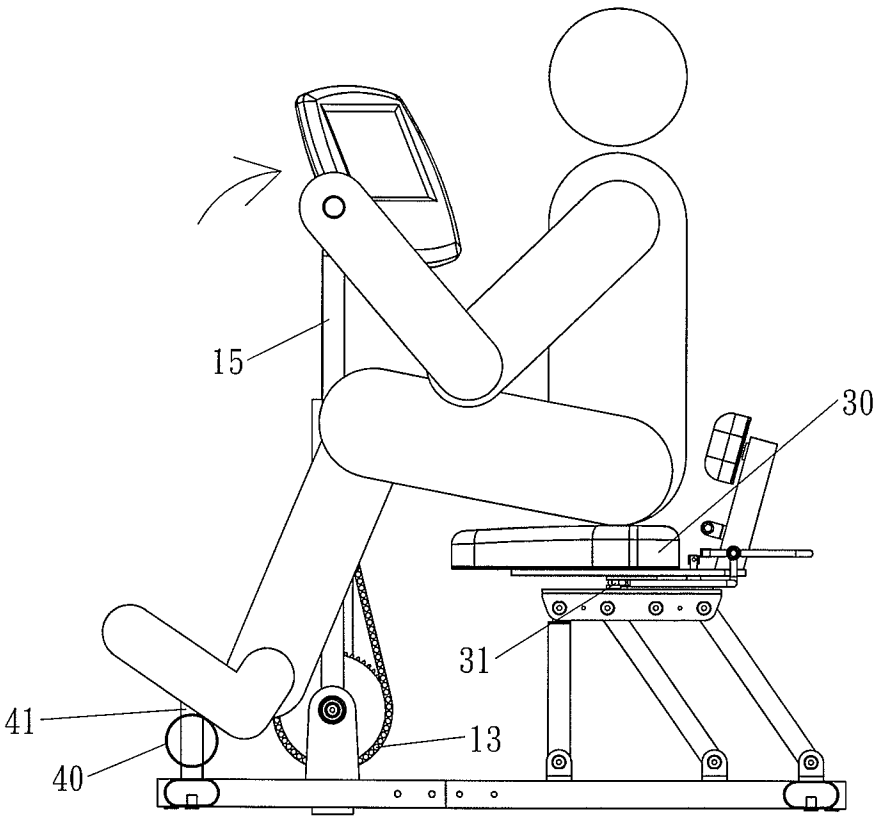
FIG. 5 is a side operational view of the rehabilitation exercising equipment as shown in FIG. 2.

In operation, referring to FIGS. 4 and 5 with reference to FIGS. 1-3, the connecting member 13 connects the first geared member 12 and the second geared member 19. In such a manner, when the control handle 5 is pivoted relative to the support post 11 of the frame unit 1, the first geared member 12 is driven by the control handle 5 to drive the connecting member 13 and the second geared member 19 so that the control handle 5 can drive the connecting member 13. Thus, a user's hands can hold the control handle 5 to move the control handle 5 forward and backward as shown in FIGS. 4 and 5 so as to exercise or rehabilitate the user's waist, arms and legs, thereby achieving an exercising or rehabilitating function. At this time, the user's feet are supported by the foot support 40. In addition, the control handle 5 is moved to abut the limit rod 41 so that the limit rod 41 can be used to stop and limit the control handle 5 so as to prevent the control handle 5 from being moved to an excessive extent.

Figure 6:
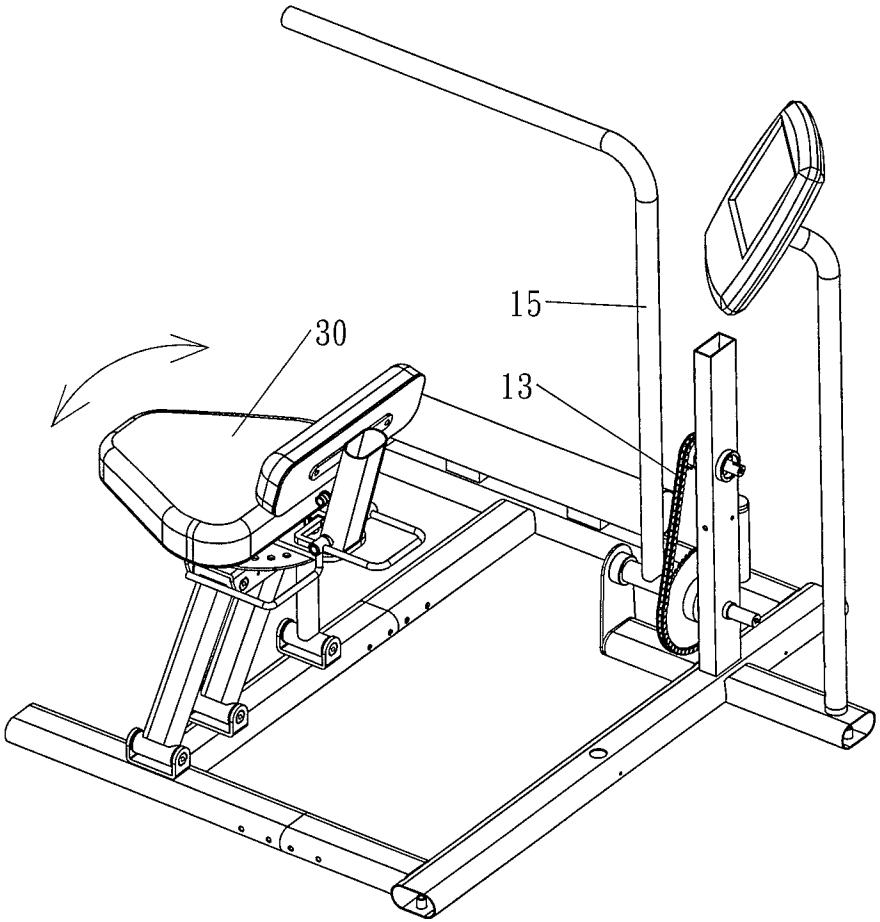
FIG. 6 is a perspective operational view of the rehabilitation exercising equipment as shown in FIG. 2.
Figure 7:
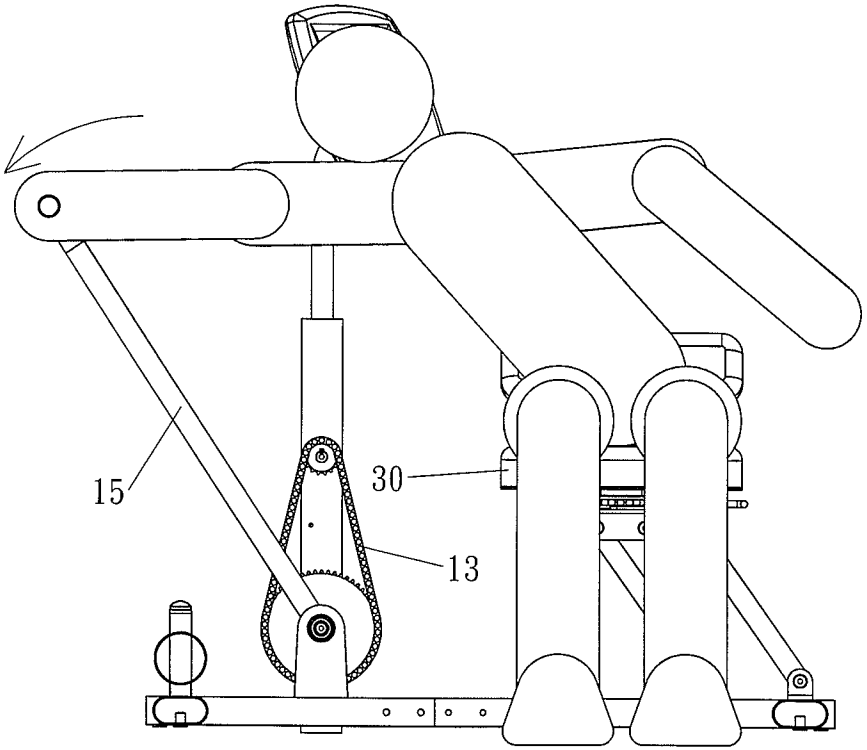
FIG. 7 is a front operational view of the rehabilitation exercising equipment as shown in FIG. 6.
Figure 8:
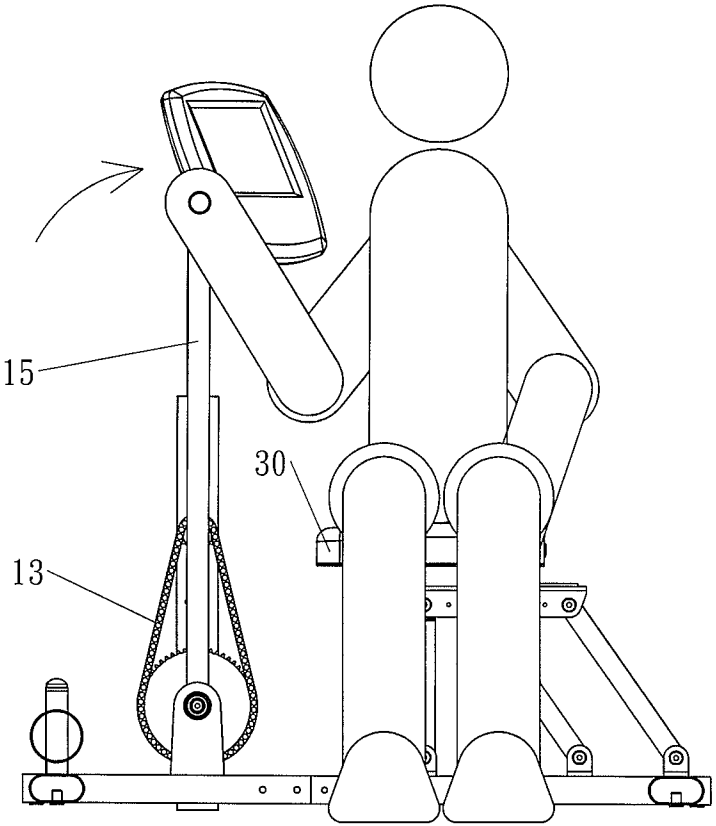
FIG. 8 is a front operational view of the rehabilitation exercising equipment as shown in FIG. 6.

Alternatively, referring to FIGS. 6-8 with reference to FIGS. 1-5, the bearing 31 is mounted between the seat unit 30 and the frame unit 1 so that the seat unit 30 is swivelable relative to the frame unit 1 to change the orientation of the seat unit 30 as shown in FIG. 6. In such a manner, the user's hands can hold the control handle 5 to move the control handle 5 rightward and leftward as shown in FIGS. 7 and 8 so as to exercise or rehabilitate the user's waist and arms, thereby achieving an exercising or rehabilitating function.

Figure 9:
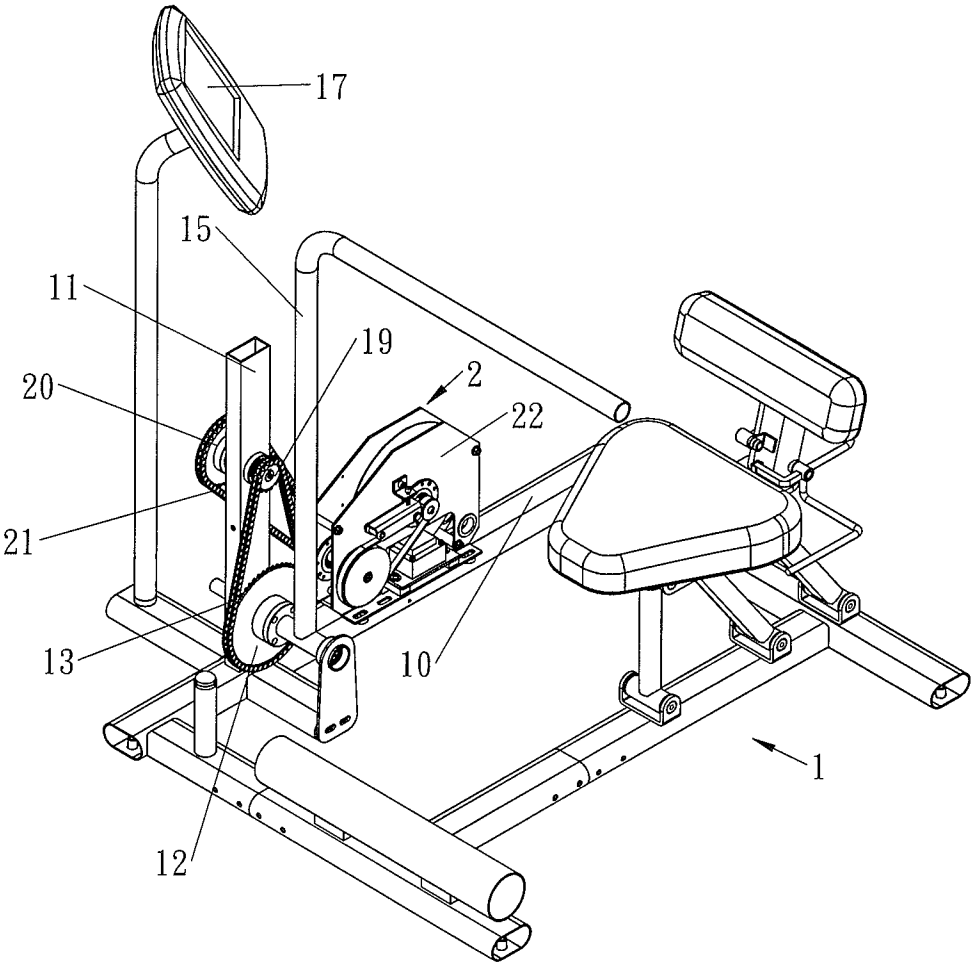
FIG. 9 is a perspective view of a rehabilitation exercising equipment in accordance with another preferred embodiment of the present invention.
Figure 10:
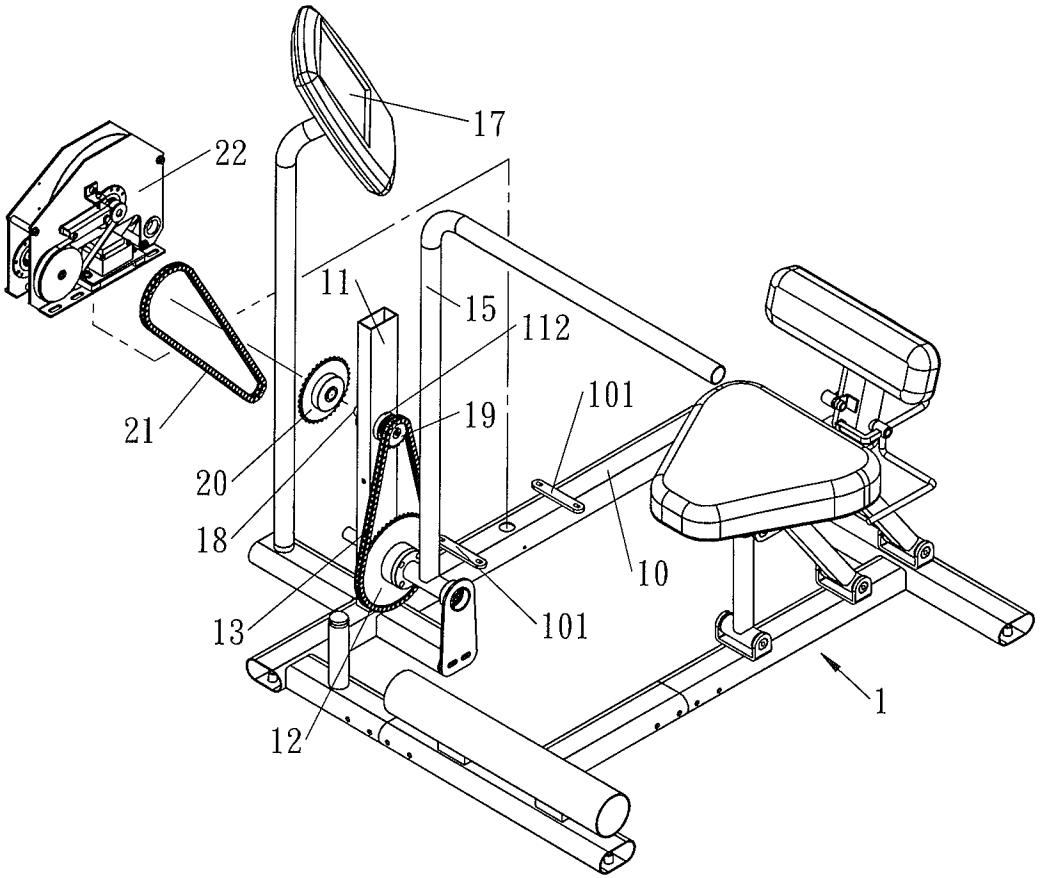
FIG. 10 is an exploded perspective view of the rehabilitation exercising equipment as shown in FIG. 9.
Figure 11:
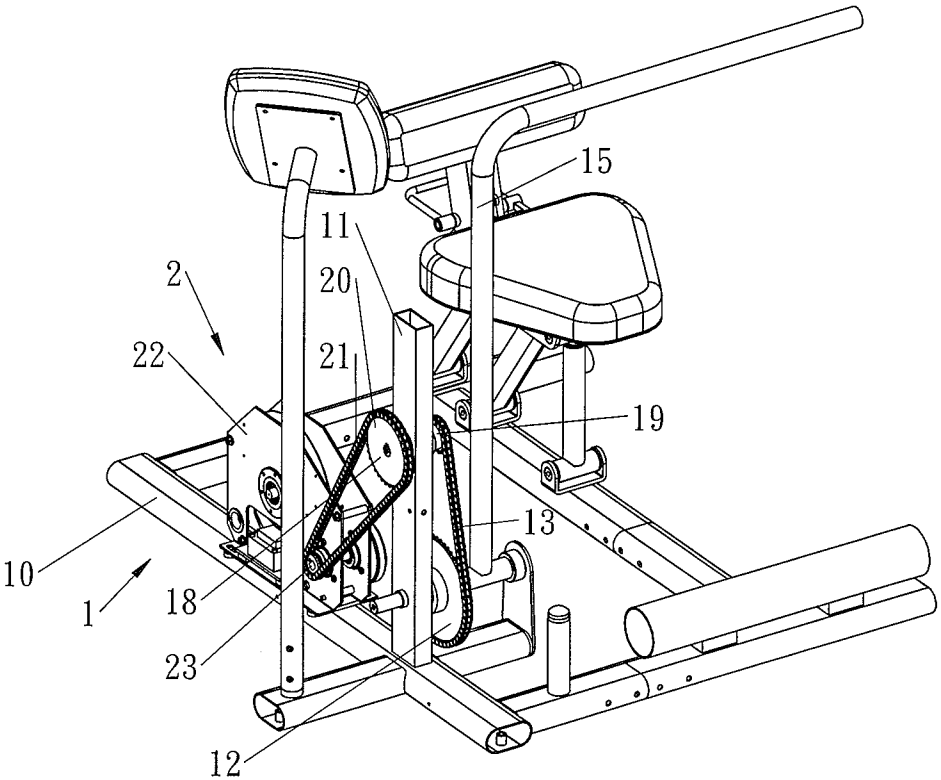
FIG. 11 is another perspective view of the rehabilitation exercising equipment as shown in FIG. 9.

Referring to FIGS. 9-11, the rehabilitation exercising equipment further comprises a transmission mechanism 2 mounted between the frame unit 1 and the second geared member 19. The transmission mechanism 2 includes a drive geared member 20 connected with the second geared member 19 to rotate in concert with the second geared member 19, a drive unit 22 mounted on the frame unit 1, a driving geared member 23 rotatably mounted on the drive unit 22, and a linking member 21 mounted between the driving geared member 23 and the drive geared member 20 to link the driving geared member 23 and the drive geared member 20.

The drive unit 22 of the transmission mechanism 2 is electrically connected to and controlled by the control panel 17 of the frame unit 1. The frame unit 1 further includes a plurality of fixing plates 101 mounted on the main frame 10 to support the drive unit 22 of the transmission mechanism 2. The drive geared member 20 of the transmission mechanism 2 is secured on the rotation shaft 18 of the frame unit 1 to rotate in concert with the rotation shaft 18 of the frame unit 1 so that the drive geared member 20 of the transmission mechanism 2 is connected with the second geared member 19 by the rotation shaft 18 of the frame unit 1.

In the preferred embodiment of the present invention, the drive unit 22 of the transmission mechanism 2 is a magnetically controlled resistance device. Alternatively, the drive unit 22 of the transmission mechanism 2 is a powered motor. In addition, the linking member 21 of the transmission mechanism 2 is a toothed belt. Alternatively, each of the driving geared member 23 and the drive geared member 20 of the transmission mechanism 2 is a sprocket, and the linking member 21 of the transmission mechanism 2 is a chain meshing with the sprocket.

In operation, when the drive unit 22 of the transmission mechanism 2 is a magnetically controlled resistance device, the drive unit 22 provides a damping force to the driving geared member 23 and the drive geared member 20 by connection of the linking member 21 to damp rotation of the second geared member 19 and to damp rotation of the first geared member 12 by connection of the connecting member 13 so as to provide a resistance to the control handle 5 so that the user has to apply a larger force to drive and pivot the control handle 5 relative to the frame unit 1, thereby enhancing the exercising or rehabilitating effect. At this time, the damping force of the drive unit 22 is controlled by the control panel 17 of the frame unit 1.

Alternatively, when the drive unit 22 of the transmission mechanism 2 is a powered motor, the drive unit 22 drives the driving geared member 23 which drives the linking member 21 which drives the drive geared member 20 which drives the rotation shaft 18 which drives the second geared member 19 which drives the connecting member 13 which drives the first geared member 12 which drives the control handle 5 so that when the user holds the control handle 5, the control handle 5 is moved and pivoted by the first geared member 12 to move the user forward and backward so as to achieve a rehabilitating function automatically.

Accordingly, a user's hands can hold the control handle 5 to move the control handle 5 forward and backward so as to exercise or rehabilitate the user's waist, arms and legs, thereby achieving an exercising or rehabilitating function. In addition, the drive unit 22 of the transmission mechanism 2 functions as a magnetically controlled resistance device to provide a resistance to the control handle 5 so that the user has to apply a larger force to drive and pivot the control handle 5 relative to the frame unit 1, thereby enhancing the exercising or rehabilitating effect. Further, the drive unit 22 of the transmission mechanism 2 functions as a powered motor to drive the control handle 5 relative to the frame unit 1 and to move the user forward and backward so as to achieve a rehabilitating function automatically.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. Rehabilitation exercising equipment comprising:

a frame unit;

a seat unit mounted on the frame unit;

a first geared member rotatably mounted on the frame unit;

a second geared member rotatably mounted on the frame unit, wherein the frame unit includes:

a main frame;

an upright support post mounted on the main frame to support the first geared member and the second geared member; and a rotation shaft rotatably mounted on the upright support post and connected with the second geared member;

a connecting member mounted between the first geared member and the second geared member to connect the first geared member and the second geared member so that the first geared member and the second geared member are movable in concert with each other; and a control handle connected with the first geared member and having the control handle with a first end connected with the first geared member to move in concert with the first geared member and a second end provided with a grip portion, wherein:

the second geared member is secured on the rotation shaft of the frame unit to rotate in concert with the rotation shaft of the frame unit;

the second geared member is located above the first geared member the support post of the frame unit is provided with a shaft hole to support the rotation shaft; and the rotation shaft of the frame unit is rotatably mounted in the shaft hole of the support post.

2. The rehabilitation exercising equipment of claim 1, wherein the first end of the control handle is provided with a first connector connected with the first geared member.

3. The rehabilitation exercising equipment of claim 2, wherein the first geared member has a side provided with a second connector connected with the first connector of the control handle.

4. The rehabilitation exercising equipment of claim 1, wherein the control handle has a substantially inverted L-shaped profile.

5. The rehabilitation exercising equipment of claim 1, wherein:

the frame unit further includes a support shaft mounted on the upright support post to support the first geared member; and the first geared member is rotatably mounted on the support shaft of the frame unit

6. The rehabilitation exercising equipment of claim 1, further comprising a bearing mounted between the seat unit and the frame unit; and wherein the seat unit is mounted on the main frame of the frame unit.

7. The rehabilitation exercising equipment of claim 1, further comprising an upright limit rod mounted on the frame unit to limit a further movement of the control handle; and wherein:

the limit rod is mounted on the main frame of the frame unit; and the control handle is movable relative to the frame unit to abut the limit rod.

8. The rehabilitation exercising equipment of claim 1, further comprising a foot support mounted on the frame unit; and wherein the foot support is mounted on the main frame of the frame unit.

9. The rehabilitation exercising equipment of claim 1, wherein:

the frame unit further includes:

a support beam mounted on the main frame; and a mounting bracket connected with the support beam and abutting the control handle to support the control handle;

the first end of the control handle is disposed between the first geared member and the mounting bracket of the frame unit; and the first end of the control handle is rotatably mounted on the mounting bracket of the frame unit.

10. The rehabilitation exercising equipment of claim 1, further comprising a transmission mechanism mounted between the frame unit and the second geared member; and wherein the transmission mechanism includes:

a drive geared member connected with the second geared member to rotate in concert with the second geared member;

a drive unit mounted on the frame unit;

a driving geared member rotatably mounted on the drive unit; and a linking member mounted between the driving geared member and the drive geared member to link the driving geared member and the drive geared member.

11. The rehabilitation exercising equipment of claim 10, wherein:

the frame unit further includes:

a transverse extension mounted on the main frame;

an upright support bar mounted on the extension; and a control panel mounted on the support bar;

the drive unit of the transmission mechanism is electrically connected to and controlled by the control panel of the frame unit; and the frame unit further includes a plurality of fixing plates mounted on the main frame to support the drive unit of the transmission mechanism.

12. The rehabilitation exercising equipment of claim 10, wherein:

the drive geared member of the transmission mechanism is secured on the rotation shaft of the frame unit to rotate in concert with the rotation shaft of the frame unit; and the drive geared member of the transmission mechanism is connected with the second geared member by the rotation shaft of the frame unit.

13. The rehabilitation exercising equipment of claim 1, wherein:

each of the first geared member and the second geared member is a sprocket; and the connecting member is a chain meshing with the sprockets.

14. The rehabilitation exercising equipment of claim 10, wherein:

the connecting member is a toothed belt; and the linking member of the transmission mechanism is a toothed belt.

15. The rehabilitation exercising equipment of claim 10, wherein the drive unit of the transmission mechanism is a magnetically controlled resistance device or a powered motor.

16. The rehabilitation exercising equipment of claim 10, wherein:

each of the driving geared member and the drive geared member of the transmission mechanism is a sprocket; and the linking member of the transmission mechanism is a chain meshing with the sprockets.

* * * * *